United States Patent [19]

Neese

[11] 4,361,952

[45] Dec. 7, 1982

[54] METHOD OF ADJUSTING AIR GAP OF AN ELECTRIC HORN

[75] Inventor: James A. Neese, Flora, Ill.

[73] Assignee: Sparton Corporation, Jackson, Mich.

[21] Appl. No.: 236,662

[22] Filed: Feb. 23, 1981

[51] Int. Cl.[3] ..... H04R 31/00

[52] U.S. Cl. ..... 29/594; 29/169.5; 29/407; 29/526 R; 116/142 R; 179/114 R

[58] Field of Search ..... 29/169.5, 594, 407, 29/526 R; 179/114 R; 181/159; 116/142 R

[56] References Cited

U.S. PATENT DOCUMENTS

| | | | |
|---|---|---|---|
| 1,790,004 | 1/1931 | Dorsey . | |
| 2,677,875 | 5/1954 | White et al. | 29/169.5 X |
| 3,396,449 | 8/1968 | Brantner | 29/407 X |
| 3,412,219 | 11/1968 | Karau | 179/114 |
| 3,516,088 | 6/1970 | Allport | 340/388 |
| 3,566,509 | 3/1971 | Caparone et al. | 29/407 |
| 3,800,393 | 4/1974 | Katchka | 29/407 |
| 4,116,158 | 9/1978 | Warnod | 116/142 |
| 4,124,931 | 11/1978 | Miele, Jr. | 29/407 |
| 4,134,200 | 1/1979 | Frigo | 29/594 |
| 4,135,473 | 1/1979 | Frigo | 116/142 |

*Primary Examiner*—Charlie T. Moon

*Attorney, Agent, or Firm*—Beaman & Beaman

[57] ABSTRACT

The invention pertains to an electric diaphragm horn and the method of air gap adjustment wherein the horn utilizes an electric coil mounted with a housing which includes a pole piece; a diaphragm being mounted upon the housing including a plunger to be spaced from the pole piece at a predetermined dimension to produce the desired sound output level. The housing bottom wall is deformed to an extent determined by measurements relative to the housing diaphragm mounting surface whereby assembly of the diaphragm to the housing produces a uniform gap between the pole piece and plunger resulting in a consistency of assembled dimensions. Further, the invention includes an electric horn construction utilizing a diaphragm wherein the motor chamber is vented to the atmosphere through a projector mounted upon the horn housing.

3 Claims, 6 Drawing Figures

METHOD OF ADJUSTING AIR GAP OF AN ELECTRIC HORN

BACKGROUND OF THE INVENTION

Acoustical vehicle horns commonly include a sheet metal housing having side and bottom walls and a circular mounting flange for receiving diaphragm and projector structure. The diaphragm and projector are usually connected to the housing flange simultaneously by bolts, rivets, welds or other conventional mechanical means.

An electromagnetic coil mounted within the housing adjacent the bottom wall internally receives a ferromagnetic pole piece fixed to the housing, and a ferromagnetic plunger attached to the diaphragm also extends into the coil having electric switch means associated therein wherein axial movement of the diaphragm operates the switch means for cycling energization of the coil to produce rapid axial vibration of the diaphragm to produce the desired audio frequencies and sound output level at the projector flare.

The characteristics of the audio signal generated are a result of the rate of diaphragm frequency vibration, and the displacement of the vibrating diaphragm and the sound output level is largely determined by the dimension of the air gap that exists between the innermost surfaces of the pole piece and plunger which are in opposed facing relationship. The dimension of the air gap between the opposed surfaces of the pole piece and diaphragm plunger must be such that these components do not touch, but an optimum electromagnetic induction takes place which adds to the vibration of the diaphragm and frequency of diaphragm vibration, and when "tuning" vehicle horns of this type the air gap dimension must be closely regulated in order to produce a desired sound output level. U.S. Pat. Nos. 3,412,219; 3,516,088; 4,116,158 and 4,135,473 disclose various approaches to adjusting the aforementioned air gap.

Automobile horns are mass produced and cost of manufacture is closely controlled and high production fabrication and assembly techniques are employed in their manufacture. The metal housing in which the electromagnetic coil is mounted is formed of drawn sheet metal, and this drawing fabrication step does not result in an accurately dimensioned housing due to variations in the metal ductility, and "spring back". Accordingly, due to the difficulty of maintaining accurate manufacturing tolerances electromagnetic vehicle horns will vary in the level of sound output if adjustment means are not utilized to overcome such tolerance variations, as described in the aforementioned patents.

Adjustment of the air gap between the pole piece and diaphragm plunger by the use of extra components, or machined surfaces, threads, etc. adds significant cost to the manufacture, and in U.S. Pat. No. 4,135,473 a method of horn adjustment is disclosed wherein the axial dimension of the housing is varied by deforming the housing sidewalls by regulating the dimension of a radially extending housing sidewall ridge. The disclosure of this patent permits the horn air gap to be adjusted after the horn components are completely assembled. However, the techniques disclosed in this patent are relatively expensive to practice due to the time involved, and the complexity of the apparatus employed.

It is an object of the invention to provide a method for assembling an electromagnetic horn wherein the critical dimensions of the horn housing are determined prior to assembly of the housing and diaphragm, and the horn housing is deformed to compensate for dimensional variations whereby the proper housing dimensions are achieved prior to assembly resulting in a uniform pitch audio output.

A further object of the invention is to provide a method of adjusting an electromagnetic audio alarm device utilizing a sheet metal housing wherein critical dimensions of the housing are determined, and modified if necessary, prior to assembly of a vibratable diaphragm to the housing.

A further object of the invention is to provide an electromagnetic horn construction wherein the horn utilizes a sheet metal housing having a diaphragm attached thereto defining a closed chamber, and wherein vent means are employed for the chamber which minimizes the likelihood of moisture entering the chamber.

In the practice of the invention a sheet metal horn housing of a cup configuration includes an electromagnetic coil mounted adjacent a bottom wall of the housing having a housing mounted pole piece located therein. The housing includes sidewalls terminating in an annular flange which defines a diaphragm mounting surface for receiving both a diaphragm and a spiral projector. The diaphragm includes a ferromagnetic plunger mounted thereon which extends into the coil, and opposed surfaces defined upon the pole piece and plunger form an air gap whose dimension is critical for producing a predetermined sound output level upon diaphragm vibration.

Prior to assembly of the housing and diaphragm, a measurement is taken between the housing diaphragm mounting surface and the pole piece gap surface, and another measurement is taken between the diaphragm mounting surface and its plunger gap defining surface. These two dimensions are compared, and an axial force is imposed upon the housing which axially deforms the housing bottom wall to an extent as determined by the difference of the aforementioned dimensions such that, upon assembly, a predetermined dimension is produced between the gap defining surfaces of the pole piece and plunger which results in a predetermined sound output level. Thus, the aforedescribed method of housing dimensioning overcomes any dimensional variations that may exist in the manufacture of the housing, or the manufacture and assembly of the diaphragm and its plunger.

Further, the horn of the invention utilizes unique venting means defined in the stem of the plunger by which the plunger is attached to the diaphragm. This arrangement permits the motor chamber of the horn to be vented into the projector reducing the likelihood of moisture or foreign matter entering the chamber through the vent. Additionally, the structure for attaching the diaphragm to the plunger includes a shaped washer which permits maximum clearance between the plunger stem and projector inlet resulting in high sound generation efficiency and transmission.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
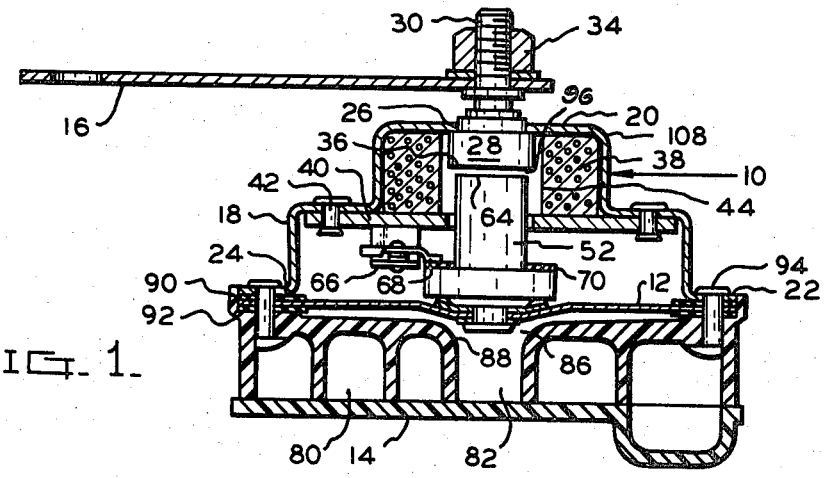
FIG. 1 is an elevational, diametrically sectioned view of an assembled horn in accord with the invention, as taken along Section I—I of FIG. 2.
Figure 2:
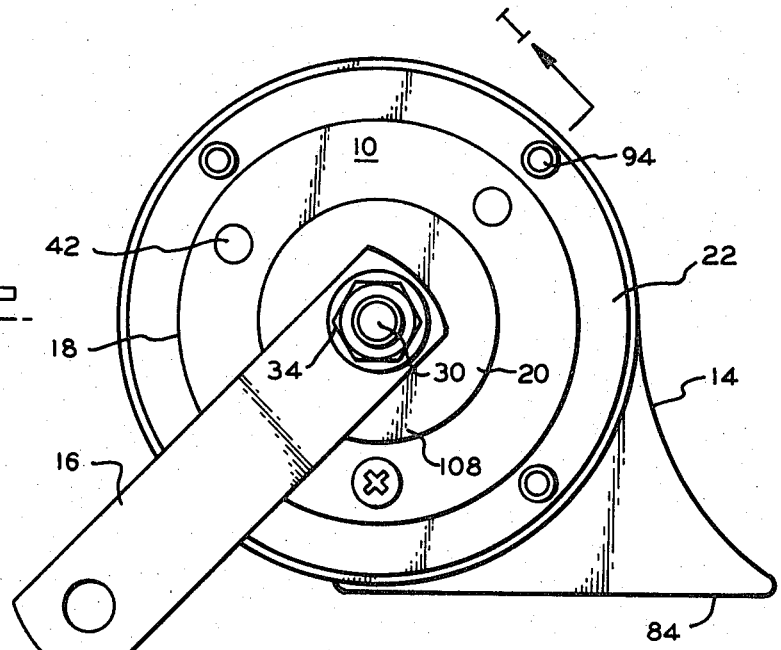
FIG. 2 is a top plan view of the horn assembly.

With reference to FIGS. 1 and 2, it will be appreciated that an electromagnetic horn in accord with the inventive concepts utilizes a sheet metal housing 10, a diaphragm 12, and a projector 14. The horn assembly is mounted to support structure, not shown, by a bracket 16.

The sheet metal housing 10 is usually formed by a progressive drawing process and includes a stepped sidewall 18 and a relatively flat bottom wall 20. The sidewall 18 terminates in an annular radially extending flange 22 having a flat diaphragm assembly mounting surface 24. The bottom wall 20 includes a circular opening 26 in which the ferromagnetic pole piece 28 is staked, and thereby affixed to the housing. The pole piece includes a threaded stem 30 having a shoulder 32 whereby the bracket 16 is received upon the stem and fixed thereto by nut 34. The pole piece 28 also includes a flat radial inner end surface 36 which defines the air gap surface, as later described.

An electromagnetic coil 38 is fixed within the housing 10 adjacent the bottom wall 20, and the coil is maintained in position by annular mounting plate 40 affixed to the housing by rivets 42. The coil 38 includes a central cylindrical bore 44 in which the pole piece 28 is located.

The diaphragm 12 includes a peripheral portion 46 provided with spaced holes for receiving the assembly fasteners, and the diaphragm may be indented at its central region at 48, and includes a central opening 50 for permitting attachment of the ferromagnetic plunger 52 thereto. The plunger 52 is of a stepped cylindrical configuration and includes a cylindrical stem 54, an annular shoulder 56, an enlarged cylindrical portion 58 defining shoulder 60, and a minimum diameter portion 62 which extends into the coil opening. The end of the portion 62 is of a radial flat radial configuration to form surface 64 which defines the air gap.

An electric switch 66 includes a member 68 engaging an insulated washer 70 mounted upon the plunger shoulder 60 whereby movement of the plunger opens and closes the contacts of the switch 66 which controls energization of the coil 38.

Figure 6:
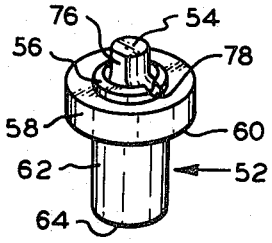
FIG. 6 is a perspective view of the diaphragm plunger, per se.

The plunger 52 is mounted upon the diaphragm 12 by the stem 54, the stem extending through the diaphragm opening 50 and being upset to overlie washer 72. A washer 74 may also be inserted between the diaphragm and the plunger shoulder 56. As will be appreciated from FIG. 6, the plunger stem 54 is flattened at 76, and at least one radial passage 78 is defined in the plunger shoulder 56 wherein the passage 78 and flattened portion 76 form a vent passage through the diaphragm. It is to be understood that in the upsetting of the end of the stem 54 the passage defined by the flattened portion 76 remains.

As will be appreciated from FIG. 1, the washer 72 includes an obliquely oriented exterior surface coverging in a direction toward the projector 14, and as the upset metal of the plunger stem is also obliquely oriented a maximum clearance exists between the central region of the diaphragm and the projector inlet.

The projector 14 is preferably of a synthetic plastic material and includes a spirally oriented passage 80 having an inlet 82 coaxially related to the axis of the diaphragm 12, and the enlarged bell 84 of the projector constitutes the outlet for the sound vibrations. As appreciated from FIG. 1, the oblique orientation of the periphery of the washer 72 and the plunger upset metal provides significant clearance at 86 between these components and the projector inlet radius surfaces 88 assuring high efficiency of air movement, and vibration transmission into the projector inlet.

Annular gaskets 90 and 92 are usually located upon opposite sides of the periphery of the diaphragm, and fasteners 94 simultaneously assemble the diaphragm, gaskets and projector to the housing flange.

The aforedescribed electromagnetic horn assembly operates in the normal manner wherein energization of the coil 38 draws the plunger 52 further into the coil bore 44 producing diaphragm movement, such plunger displacement opens the contacts of switch 66 deenergizing the coil whereby the resilient nature of the diaphragm biases the plunger toward the projector, closing the switch contacts and repeating the cycle. The resultant rapid diaphragm movement produces the desired audio vibrations, and the air gap 96 defined between the pole piece surface 36 and the plunger surface 64 alternately increases and diminishes during horn operation due to plunger motion.

Venting of the internal chamber of the horn defined by the housing 10 and diaphragm 12 occurs through passage 78 and flattened portion 76 into the inlet of the projector 14, and as the length of the projector passage 80 is significant the likelihood of moisture or foreign matter entering the horn internal chamber is unlikely.

As previously discussed, the axial dimension of the air gap 96 between surfaces 36 and 64 is important with respect to the sound output level of the audio signal created and it is important that the dimensions of the assembled components be such that the dimension of the air gap be closely controlled. Manufacturing tolerances existing in the housing 10, pole piece 28, diaphragm 12, washers 72 and 74, and plunger 52 will all affect the dimension of the air gap 96, and in the following description a technique is described for producing a consistent audio signal in a plurality of electromagnetic horns produced on a high production basis.

Figure 3:
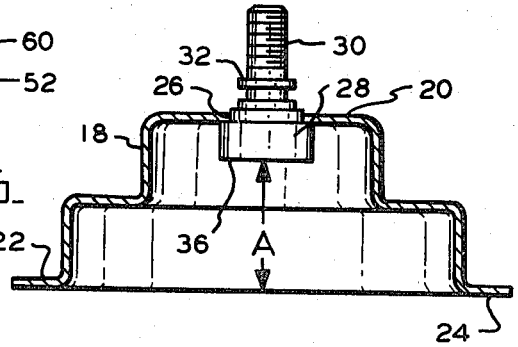
FIG. 3 is an elevational, diametrical sectional view of the horn housing prior to assembly with the diaphragm.

After the sheet metal housing 10 has been formed the pole piece 28 is mounted therein by staking, and the assembly will be as shown in FIG. 3. Once the pole piece has been firmly attached to the housing 10 the housing is placed in measuring apparatus, not shown, which measures the distance from the pole piece surface 36 to the diaphragm mounting surface 24 defined on the housing as represented by dimension A in FIG. 3.

Figure 4:
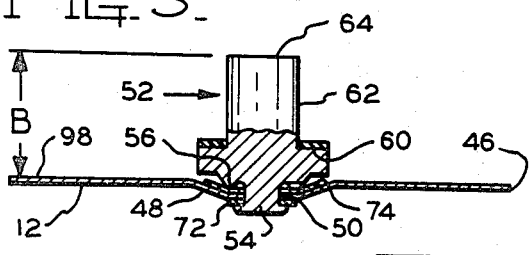
FIG. 4 is an elevational, diametrical sectional view of the assembled diaphragm and plunger prior to assembly to the housing.

The diaphragm 12 is assembled to the plunger 52 whereby these components, and their associated washers 72 and 74 constitute the subassembly shown in FIG. 4. This subassembly is placed upon measurement apparatus, not shown, whereby the distance from the mounting surface 98 of the diaphragm to the plunger gap surface 64 is determined, as represented by dimension B on FIG. 4.

After the dimensions A and B have been determined the housing subassembly is placed in housing deforming means which includes an anvil 100 having a central opening 102 and an annular radiused cavity 104 having a radius 106 which corresponds to the radius 108 of the housing 10. A ram 110 is then brought against the pole piece surface 36 and the pole piece is forced in the direction of its thread stem 30 to deform the housing bottom wall 20 by a stretching of the metal thereof past its yield point. Such deformation of the housing bottom is permanent, and will change the dimension A with respect to its original value.

The measuring apparatus used in the determination of the dimensions A and B forms no part of the present invention, but is of a conventional automatic type whereby these dimensions can be automatically determined and compared. It will be appreciated that upon subtracting dimension B from dimension A, and compensating for the thickness of gasket 90, and deforming bottom wall 20 in accord with these valves that the dimension of the resultant air gap 96 can readily be determined upon the measured housing and diaphragm subassemblies being assembled.

Figure 5:
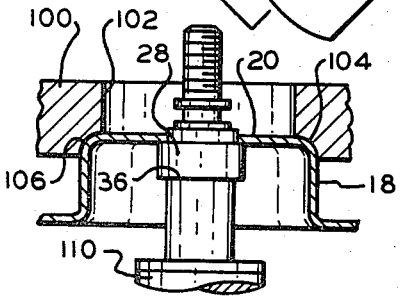
FIG. 5 is an elevational sectional view illustrating the apparatus for deforming the housing in accord with the invention.

After the measuring apparatus compares the dimensions A and B of given subassemblies the deforming apparatus shown in FIG. 5, which may be hydraulically operated, automatically displaces the pole piece 28, and housing bottom wall 20, a distance sufficient to vary dimension A to produce the desired air gap dimension when the subassemblies are assembled. The measurement of the housing and diaphragm subassemblies, and the deformation of the housing, are all automatically achieved under production line conditions, and each horn manufactured has its housing and diaphragm subassemblies measured, and its housing bottom wall dimensioned, if necessary, to result in the desired air gap dimension 96 once horn assembly is finalized.

It is preferable that the dimension A be determined by measuring to surface 24, and B be determined by using surface 98, however, it would be possible to mount the gasket 90 to surfaces 24 or 98, or incorporate a dimension into the measuring apparatus equal to the thickness of gasket 90, in obtaining the dimensions, A or B, and such modifications are within the scope of the invention.

With the disclosed embodiment the manufacturing dimensions of the housing 10 are predetermined wherein the dimension A will be equal to, or less than, the desired dimension required during final assembly whereby deformation of the housing bottom wall will always be in the direction of the pole piece threaded stem 30. However, it is within the concept of the invention to deform the housing bottom wall 20 "inwardly" to produce the desired dimensional relationship, and in such instance the relative locations of the anvil 100 and ram 110 would have to be reversed.

It will be appreciated that the aforedescribed method of electromagnetic horn assembly will permit such horns to be manufactured on a high production basis, and yet uniform pitch, sound output level and audio characteristics can be consistently maintained and it is understood that various modifications to the inventive concepts may be apparent to those skilled in the art without departing from the spirit and scope of the invention.

I claim:

1. The method of adjusting the air gap between the pole piece and plunger of an electric horn wherein the horn includes a sheet metal housing of cup configuration having a sidewall and a bottom wall, an electromagnetic coil within the housing adjacent the walls thereof, a pole piece fixed relative to the bottom wall within the coil, a diaphragm mounted upon the housing having a ferromagnetic plunger affixed thereto extending into the coil toward the pole piece, the housing including a diaphragm mounting surface engagable by a mounting surface defined on the diaphragm adjacent its periphery, the pole piece and plunger each including opposed spaced gap surfaces defining an air gap whose dimension determines the horn audible characteristics and electric switch means operated by the plunger to cyclic energize the coil, comprising the steps of measuring the distance from the housing diaphragm mounting surface to the pole piece gap defining surface to obtain a first dimension, measuring the distance from the diaphragm mounting surface to the plunger gap defining surface to obtain a second dimension, determining the difference between said first and second dimensions, deforming the housing to vary said first dimension in accord with the difference between said first and second dimensions whereby upon assembly of the housing and diaphragm a predetermined air gap dimension will result, and assemblying the housing and diaphragm.

2. The method of horn air gap adjustment as in claim 1 wherein the step of deforming the housing comprises deforming only the housing bottom wall.

3. The method of horn air gap adjustment as in claim 1 wherein the deformation of the housing is produced by fixedly supporting the housing at the intersection of the side and bottom walls and applying an axial force upon the pole piece to deform the housing bottom wall.

* * * * *